United States Patent [19]

Schmid

[11] 4,448,415

[45] May 15, 1984

[54] BOWLING PIN SWEEPER MOVING APPARATUS

[75] Inventor: August Schmid, Schwerzenbach, Switzerland

[73] Assignee: Patentverwertungs-und Finanzierungsgesellschaft SERANIA AG, Glarus, Switzerland

[21] Appl. No.: 393,795

[22] Filed: Jun. 30, 1982

[51] Int. Cl.[3] ..... A63D 5/08

[52] U.S. Cl. ..... 273/54 A

[58] Field of Search ..... 273/43 R, 43 A, 54 A; 172/266, 267

[56] References Cited

U.S. PATENT DOCUMENTS

| | | | |
|---|---|---|---|
| 256,356 | 4/1882 | Morter | 172/267 |
| 668,717 | 2/1901 | Rowell | 172/267 |
| 903,867 | 11/1908 | Kalkhurst | 172/266 |
| 3,954,264 | 5/1976 | Schmid | 273/54 A |

*Primary Examiner*—Anton O. Oechsle

*Attorney, Agent, or Firm*—Frishauf, Holtz, Goodman & Woodward

[57] ABSTRACT

To improve the structure described in my earlier U.S. Pat. No. 3,954,264, and permit release of the hook (8) upon excessive force being applied by a cross-pin (21) on the hook if an inadvertent or carelessly thrown bowling ball applied a force (G) to the bowling pin wiper blade (35), the hook support arm (4, 5) is formed in two arm portions (4, 5) with a buckle joint (13) therebetween spring loaded to maintain a slightly out-of-line position of the support arm, but permitting buckling if a downward force on pin 21 (FIG. 1) pushes upwardly the camming roller (7) at the lower end of the lower arm portion (5) against a force in spring (32) and thus prevent damage to the suspension arm (1), the support arm (4, 5) and the other components of the mechanism.

14 Claims, 3 Drawing Figures

BOWLING PIN SWEEPER MOVING APPARATUS

Reference to related patent, the disclosure by which is hereby incorporated by reference, by the invertor hereof. U.S. Pat. No. 3,954,264, May 4, 1976, Schmid.

The present invention relates to bowling pins sweeper apparatus and is an improvement over my earlier U.S. Pat. No. 3,954,264, and more particularly to such apparatus which is essentially immune to damage by prematuraly, or inadvertently thrown bowling balls.

BACKGROUND

My earlier U.S. Pat. No. 3,954,264 discloses a bowling pin sweeper which is formed by a sweeper arm, moved longitudinally with respect to the bowling alley, to sweep fallen bowling pins into a pit from which they can be picked up by automatic pin removal apparatus. To provide a rapid drop of the bowling pin sweeper for removal of fallen bowling pins, without jamming of pins between the sweeper arm, an electromagnic release such as a magnet, operated as sear is triggered, for example, by movement of a bowling ball towards the pins, e.g. when the ball passes a lightgate, or other proximity sensing device. Upon having sensed that a ball has been thrown, and after it has passed the sweeper, the sear is triggered to release the sweeper arm to drop by its own weight prior to initiation of sweeping operation. The terminal portion of the drop can be braked by a dashpot. The sweeper arm, thus, will fall rapidly, and can then sweep the balls away at normal, sweeping speed. The system, thus, provides for two different speeds for different motions. A pin sweeper arm is guided on a essentially horizontal guide rails for reciprocating sweeping movement. The arm can be held in a raised position and lowered for subsequent movement along the guide rails upon initiation of the sweeping cycle. The arm is held by a holding hook which is pivotable about an essentially horizontal axis. A vertically removable frame is provided, normally located in raised position with respect to the rails. The frame is moveable to drop to a position in which the hook can engage the sweeper arm upon termination of the sweeping cycle of the sweeper arm, to raise the sweeper arm, preparatory for subsequent dropping upon the initiation of the next operating cycle. Electromagnetic means are provided connected to the means which hold the arm which, upon energization, are operable to rapidly release the arm to permit dropping thereof by gravity, thus rapidly lowering the arm. A two-part locking mechanism is provided; one of the parts is connected to the hook and is moveable therewith; the other one of the parts is operatively connected to the electromagnic means and operated thereby upon energization to unlock the second part, to permit release of the hook, and hence rapid dropping of the sweeper arm.

In actual practice it has been found that bowlers who are careless may throw a bowling ball shortly before the wiper arm has cleared the fallen pins off the bowling alley, and has not yet returned to its raised position. If, at this time, the engagement hook which is provided to raise the arm has already been engaged, and the sweeper arm is suddenly struck with the force of a bowling ball, damage to the lifting and dropping mechanism of the wiper may result.

THE INVENTION

It is an object of the present invention to improve the structure basically described in the above U.S. Pat. No. 3,954,264 to render it effectively immune to damage by inadvertently, or prematurally thrown bowling balls and to improve the reliability of operation of the system.

Briefly, the locking part which is operatively connected to the electromagnet and, upon energization, unlocks the locking mechanism is so arranged that, upon overload being applied thereto, the wiper arm is again permitted to be released. In a simple way, this can be accomplished by making the arm in two parts, with a pivot link, preferably arranged such that the two parts are not exactly aligned with each other, when in the rest position, but slightly angled so that, upon overload, the two parts can pivot with respect to each other, springs being provided to hold them in their normal slightly angled position which, however, can permit deflection of the parts with respect to each other upon being subjected to overload.

The arrangement has the advantage that a simple interposition of the a joint in one of the arms, and a spring to maintain the joint in a predetermined rest position, effectively prevents damage to the entire bowling pin removal apparatus due to inadvertent, or careless, or deliberate throw of a bowling ball against the wiper apparatus.

DRAWINGS

DESCRIPTION OF THE EMBODIMENT

Figure 1:
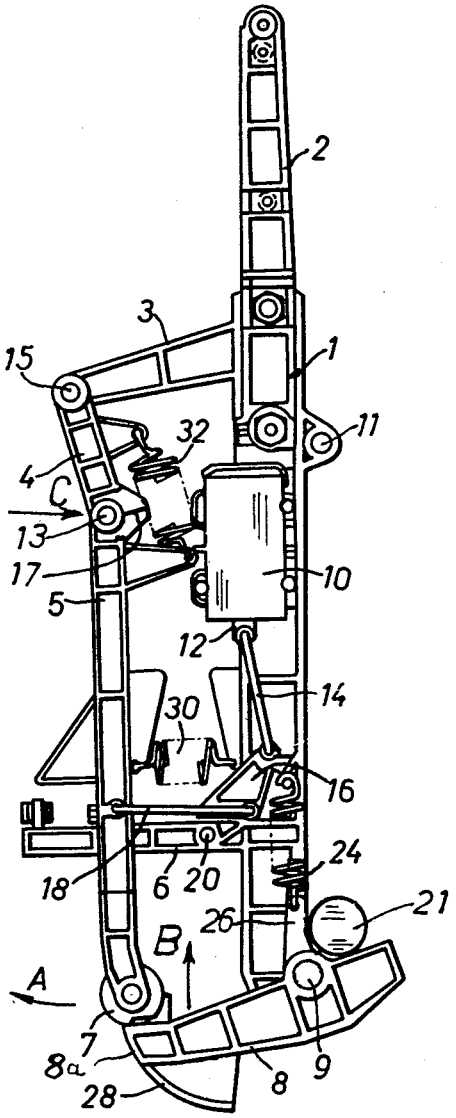
FIG. 1 is a side view of the wiper arm pickup apparatus, illustrating only so much of the system as is necessary for an updersanding.

The apparatus has a wiper 35 (FIG. 3) which is constructed in form of a frame having frame members 48, cross-connected by a board, or strip 53 at one end, and at the upper side secured to essentially triangular brackets 54. The brackets 54 support rollers 55, 56 which can run in rails 49 for respective backward and forward movement to remove fallen bowling pins 82. The wiper 35, thus, is secured to roller or carriage arrangements 50, one on either side of the wiper, to operate in the guide rails 49, and in inclined extension element 57 thereof. The carriage 50 also includes laterally projecting bolts or stubs 21 which can be engaged by a hook 8 for lifting of the wiper.

A rod 58 is secured to the wiper 35 by a link 60; the other end of the rod 58 is attached to a double arm lever 63, being pivoted thereto by a bolt 64. The double arm lever 63 is pivotable over a bolt 66 which is secured to the frame of the wiper mechanism. A lever 68 is linked by bolt 70 to the second arm of the double arm lever 63, and in turn linked by a bolt 72 to an eccentric 74 coupled to a drive motor 84. The drive motor 84 rotates its axis 76 in a direction of the arrow D.

OPERATION OF WIPERS

To remove a bowling pin 82 on the bowling element 80, an electromagnet 10 (FIGS. 1,2) is energized, which causes the hook 8 to pivot and release the wiper 35 to drop. At the same time, motor 41 (FIG. 3) is energized causing, via a V-belt 42 slow rotation of an arm 44 in the direction of the arrow E, thus slackening a chain 36 attached to arm 1, retaining the hook 8. This permits the wiper 35 to drop, and as the arm 44 continues to rotate, the hook 8 unlatches from the pin 21. Motor 84 then is energized, and upon rotation of the shaft 76 thereof, the wiper 35, now in a position shown in FIG. 3, is moved by the carriage 50 along the guide rails 49 in a direction of the arrow F, thereby sweeping bowling pins 82 on the alley 80 into a collecting or catchment area (not shown) for further removal therefrom. Upon continued rotation of the motor 84 in the direction of arrow D, the wiper 35 will be returned to the position shown in FIG. 3. Motor 84 is then stopped by a limit switch (not shown) as well known. Thereupon motor 41 is again energized to rotate in opposite direction, that is, counter the arrow E, in order to permit the hook 8 to again grip the pin 21 and to lift the wiper. The details of this operation are described in my earlier U.S. Pat. No. 3,954,264.

It may occur that, as the hook 8 tends to reengage with the pin 21, and before the arm 44 has rotated to a position to lift the wiper arm 35, by permitting escape of the roller 55 from the track extension 57, a bowling ball strikes the wiper board 53. The mechanism, in accordance with the present invention, is so improved that damage to the system is prevented nevertheless.

Figure 2:
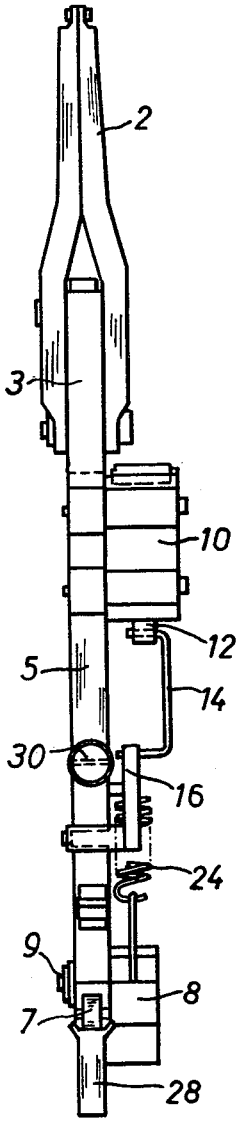
FIG. 2 is a side view of the arrangement seen from the left side of FIG. 1.
Figure 3:
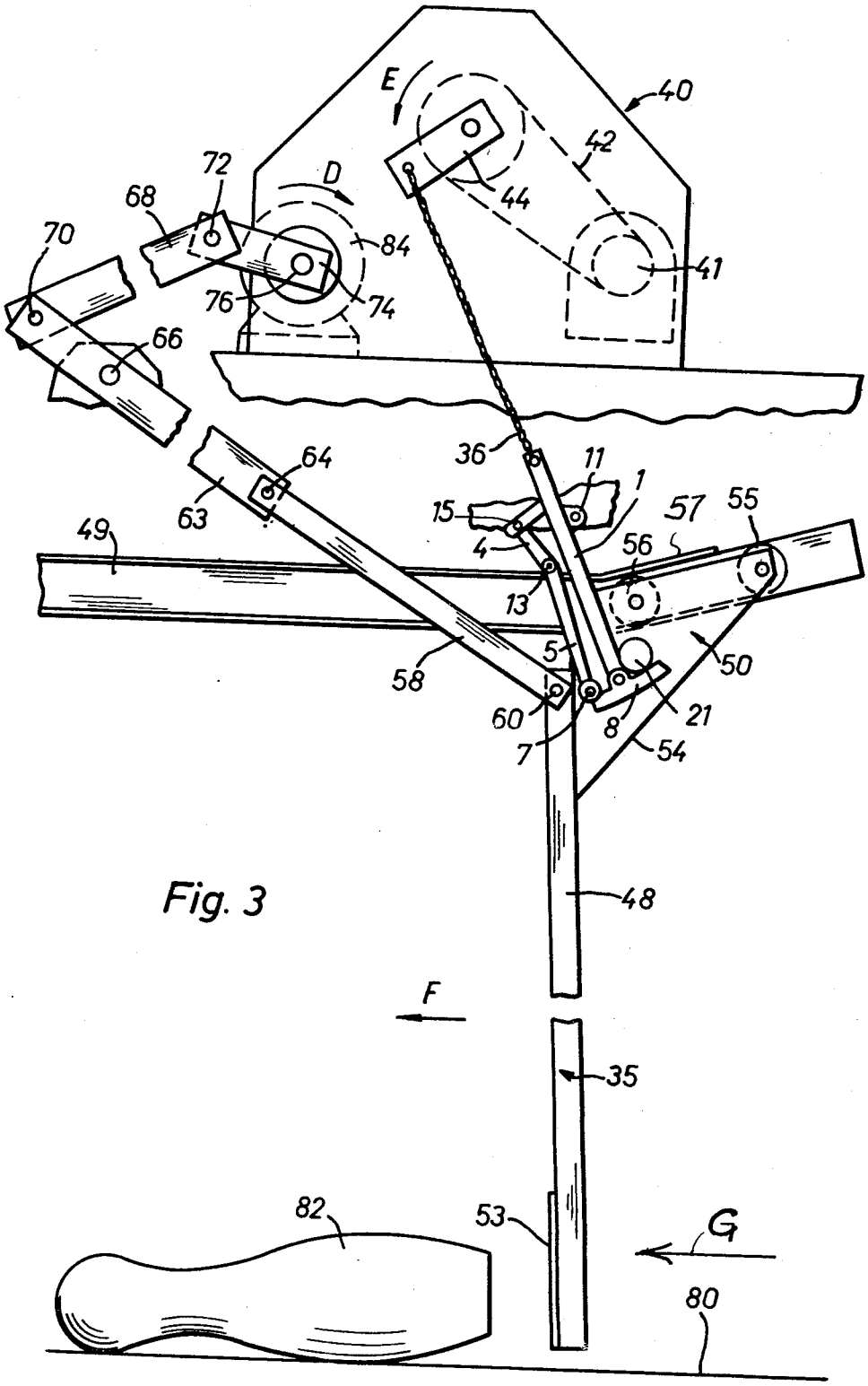
FIG. 3 is a schematic illustration of the wiper apparatus to remove fallen bowling pins.

The hook 8 is pivoted to a fixed arm 1 (see also FIGS. 1, 2). The upper region of the arm 1 has a laterally extending cross-arm or spacer or brace 3, the outer end of which is formed with a pivot or link joint 15. Link joint 15 is pivoted to a first suport arm portion 4. The lower end of support arm portion 4 is pivoted at pivot joint 13 to a second, and much longer support arm portion 5. The support arm portions 4, 5, together, form an angle support arm, which supports via a roller 7 the portion of the hook 8 which extends rearwardly beyond its pivot 9. Pivot 9 permits the hook 8 to pivot upon movement of roller 7 out of engagement therewith. Stop elements 17 are located adjacent the pivot 13, so that the two support arm portions 4, 5, will assume a quiescent or rest position in which they are slightly angled with respect to each other. A spring 32 retains the two parts 4, 5, in the position shown. The angle between the two parts is not critical; a preferred angle is about 15° off a straight line; variations of plus or minus 10° are also suitable.

The electromagnet 10, secured to the arm 1 is energized if the wiper 35 (FIG. 3) is to be released. Upon energization of the electromagnet 10, its armature 12 is pulled-in and moves rod 14, connected thereto upwardly which pivots lever 16, pivoted over a bolt 20 located on a laterally projecting arm 6 extending from the arm 1. Lever 16 is connected to a rod 18 which is pivoted to the longer support arm portion 5. Upon energization of the electromagnet 10, the longer support arm portion 5 is pushed towards the left—with respect to FIG. 1—in the direction of the arrow A, since the pivot point 20 is farther to the left than the connection of rod 18 with lever 16. The support arm portion 5 is thus pushed in the direction of the arrow A to counter the force of a retaining spring 30. Roller 7 will leave the support region of the hook 8, which then is released and can pivot in the direction of the arrow B. The weight of the wiper 35, supported on the hook 8 by the pin 21, will cause the hook 8 to pivot over pivot 9, and thus release the wiper 35 and permit it to drop rapidly downwardly—braked for example, by a dashpot, not shown herein, by disclosed and described in the reference U.S. Pat. No. 3,954,264.

Let it be assumed that, due to an untimely ball striking the wiper 35, pin 21 is pulled downwardly. Referring to FIG. 3, if a force is applied to the wiper 35 in the direction of the arrow G, pin 21 will tend to pull downwardly, causing upward pressure by the hook portion **8*a* against roller 7 and hence against the lower support arm portion 5. Damage to the support arm portion 5, the linkage 18-16-14 connected thereto is prevented since the arm 5 can pivot by pivot 13, causing the link connection formed by arm 5, arm 4 and spring 32 to buckle, and the pivot 13 to move in the direction of arrow C. This causes the lower end of the support arm portion 5 to move in the direction of the arrow A, which again releases the hook portion 8*a* of the hook and permits the hook 8 to move in the direction of the arrow B. The roller 7, then, can return along a curve or cam portion 28 along the outer end portion 8*a* of the hook 8. Thereafter, the hook 8 again returns to the quiescent position under the weight of the hook and spring 24 engaging the hook 8 over the arm 26 into the rest position shown in FIG. 1**, without requiring any manual intervention.

The drive motors and the drive arrangements for the system—as shown in FIG. 3—are located at the upper portion on a frame structure of the apparatus. Drive motor 41 is coupled over V-belt 42 with a crank drive 44, which, in turn, is connected to the chain 36 which engages the upper end of a double-holding portion 2 of the arm 1. A pivot element 11 is secured to a vertically moveable frame (not shown), reference is made to my earlier U.S. Pat. No. 3,954,264. The frame, together with bowling pin receiving cups and the like is likewise secured to the chain 36 so that, when the crank drive 44 rotates slowly, the frame likewise slowly moves up and down. The wiper 35, however, is moved downwardly not slowly, but released by the hook 8.

Various changes and modifications may be made within the scope of the inventive concept.

I claim:

1. Damage resistant bowling pin wiper operating device having a wiper (35) subject to be dropped to a vertical position, and having a holding pin projecting from an upper portion thereof;

a suspension arm (1);

a hook (8) pivotably secured (9) to the suspension arm (1) having a forwardly projecting portion engageable with the holding pin (21) and a rearwardly extending portion (**8*a***);

a support arm (4, 5) connected to the suspension arm (1) supporting the rearwardly extending portion of the hook to thereby prevent release of the pin from the hook;

an electromagnet means (10) operatively connected to the support arm to release the support arm from engagement with the rearwardly extending portion of the hook and permit release of the hook upon operation of said electromagnetic means, and wherein, in accordance with the invention, the support arm includes means (4, 5, 13, 32) including spring means (32) for releasing engagement with the extending portion (**8*a*) of the hook (8) upon excessive force being applied on the hook (8) by the pin (21**) where the hook and pin are engaged.

2. A device according to claim 1 wherein the suspension arm comprises two arm portions (4, 5) and a buckle pivot (13) therebetween, the two arm portions being retained in non-aligned slightly offset position;

and wherein the spring means (32) are positioned for maintaining said two arm portions in said slightly non-aligned position, but permitting buckling about the buckle pivot and against the force of said spring means upon application of excessive force on the hook by the pin due to force being applied against the wiper (35).

3. A device according to claim 2 wherein said arm portions are angled with respect to each other by an angle of about 15°.

4. A device according to claim 2 further including stop abutments (17) engageable with said arm portions (4, 5) limiting the extent of offset of said two arm portions.

5. A device according to claim 4 wherein said arm portions are angle with respect to each other by an angle of about 15°.

6. A device according to claim 4 wherein said buckle pivot (13) has a pivot axis extending parallel to the pivot axis (9) of said hook;

one of said arm portions (4, 5) being in engagement with said rearwardly extending portion (8*a*) of the hook, and the other arm portion (4) being pivotably secured (15) to said suspension arm (1).

7. A device according to claim 6 further comprising a camming curve (28) located on the rearwardly extending portion (8*a*) of said hook for forming a camming-and-abutment surface for the support arm upon deflection of the support arm due to application of excessive force on the hook.

8. A device according to claim 6 further comprising a spacer or brace (3) extending rearwardly from the suspension arm (1);

said other arm portion being pivotably secured (15) to said spacer or brace (3) at a position thereof remote from said suspension arm (1).

9. A device according to claim 2 further comprising a spacer or brace (3) extending rearwardly from the suspension arm (1);

and a pivot joint (15) connecting one (4) of the arm portions (4, 5) of the support arm and the spacer or brace (3) to thereby pivotably connect the support arm to the suspension arm.

10. A device according to claim 1 further comprising a camming curve (28) located on the rearwardly extending portion (8*a*) of said hook for forming a camming-and-abutment surface for the support arm upon deflection of the support arm due to application of excessive force on the hook.

11. A device according to claim 1 further comprising a space or brace (3) extending rearwardly from the suspension arm (1);

and a pivot joint (15) connecting the support arm (4, 5) and the spacer or brace (3) to thereby pivotably connect the support arm to the suspension arm.

12. Damage resistant bowling pin wiper operating device comprising a wiper (35) subject to be dropped to a vertical position and having a holding pin (21) projecting from an upper portion thereof;

a suspension arm (1);

a hook (8) pivotably secured to the suspension arm and having a forwardly projecting portion engageable with the holding pin and a rearwardly extending portion (8*a*);

a spacer or brace (3) extending rearwardly from the suspension arm (1);

a support arm (4, 5) pivotably connected (15) to the spacer or brace (3) at a position remote from the suspension arm, supporting the rearwardly extending portion of the hook to thereby prevent release of the pin from the hook;

an electromagnet means (10) operatively connected to the support arm to release the support arm from engagement with the rearwardly extending portion of the hook and permit release of the hook upon operation of said electromagnet means;

and wherein the support arm comprises two arm portions (4, 5) being retained in non-aligned slightly offset position, and a buckle joint (13) between the arm portions;

stop abutment means are provided, engageable by said arm portions (4, 5) for limiting the extent of offset of said two arm portions;

said buckle joint (13) having a pivot axis extending parallel to the pivot axis (9) of said hook;

one of said arm portions (4, 5) being in engagement with said rearwardly extending portion (8*a*) of the hook, and the other arm portion being pivotably secured (15) to said spacer or brace (3);

and spring means (32) maintaining said two arm portions in slightly non-aligned position, but permitting buckling about the buckle joint and against the force of said spring means upon application of excessive force on the hook (8) by the pin (21) due to force being applied against the wiper (35).

13. A device according to claim 12 wherein said arm portions are angled with respect to each other by an angle of about 15°.

14. A device according to claim 12 further comprising a camming curve (28) located on the rearwardly extending portion (8*a*) of said hook for forming a camming-and-abutment surface for the support arm upon deflection of the support arm due to application of excessive force on the hook.

* * * * *